US005492429A

United States Patent [19]

Hodges

[11] Patent Number: 5,492,429

[45] Date of Patent: Feb. 20, 1996

[54] POST INSTALLATION

[75] Inventor: David R. M. Hodges, Newark, United Kingdom

[73] Assignee: Poletech Systems Limited, United Kingdom

[21] Appl. No.: 146,106

[22] PCT Filed: May 11, 1992

[86] PCT No.: PCT/GB92/00841

§ 371 Date: Jan. 10, 1994

§ 102(e) Date: Jan. 10, 1994

[87] PCT Pub. No.: WO92/20889

PCT Pub. Date: Nov. 26, 1992

[30] Foreign Application Priority Data

| | | | |
|---|---|---|---|
| May 10, 1991 | [GB] | United Kingdom | 9110184 |
| Jun. 4, 1991 | [GB] | United Kingdom | 9111988 |
| Jul. 17, 1991 | [GB] | United Kingdom | 9115465 |

[51] Int. Cl.[6] ..... F16B 2/22

[52] U.S. Cl. ..... 403/372; 403/367; 403/225; 256/DIG. 5; 40/606; 248/156; 52/165

[58] Field of Search ..... 403/372, 367, 403/365, 228, 225, 359, 368, 223; 256/19, 1, DIG. 5; 404/10, 6, 9; 52/160, 165, 153, 155; 248/156; 40/606, 607

[56] References Cited

U.S. PATENT DOCUMENTS

| | | | |
|---|---|---|---|
| 306,657 | 10/1884 | Stephen | 256/1 X |
| 1,726,817 | 9/1929 | Franklin | 404/10 X |
| 2,468,985 | 5/1949 | Krotz | 403/225 |
| 2,759,734 | 8/1956 | Velepec | 403/365 X |
| 2,819,547 | 1/1958 | Clements, Jr. | 248/156 X |
| 3,338,600 | 8/1967 | Wahl | 403/372 X |
| 3,740,883 | 6/1973 | Zenhausern | 403/372 X |
| 4,636,106 | 1/1987 | Waisbrod | 403/372 X |
| 4,787,601 | 11/1988 | Rybak | 256/19 |
| 4,899,493 | 2/1990 | Blankenburg . | |
| 4,997,307 | 3/1991 | Schmanski | 404/10 |

FOREIGN PATENT DOCUMENTS

| | | | |
|---|---|---|---|
| 53680/86 | 3/1989 | Australia . | |
| 0011197 | 4/1982 | European Pat. Off. . | |
| 0173969 | 11/1987 | European Pat. Off. . | |
| 1424507 | 12/1965 | France . | |
| 2622914 | 5/1989 | France . | |
| 2641557 | 7/1990 | France . | |
| 2202795 | 7/1973 | Germany . | |
| 3545188 | 6/1987 | Germany . | |
| 3733973 | 4/1989 | Germany . | |
| 11138 | 1/1911 | United Kingdom | 52/160 |
| 1112918 | 5/1968 | United Kingdom . | |
| 1577889 | 10/1980 | United Kingdom . | |

*Primary Examiner*—Kenneth J. Dorner
*Assistant Examiner*—Harry C. Kim
*Attorney, Agent, or Firm*—Jones & Askew

[57] ABSTRACT

A device for use in erecting a post. The device comprises a tubular body intended for installation in the ground, e.g. in concrete within a hole, and a deformable collar for tightly retaining a post adapted to interengage with the tubular body in tight engagement. The collar is slightly deformed so as to receive the post and retain it in place. However, with appropriate equipment the post can be readily removed and replaced, for example, if accidentally damaged.

23 Claims, 9 Drawing Sheets

POST INSTALLATION

FIELD OF THE INVENTION

This invention relates to a device for use in the erection of posts, for example road signs, fence posts and the like.

BACKGROUND OF THE INVENTION

Prior art arrangements for post erection usually entail the digging of an appropriately sized hole, the placement of a post therein and then filling in the hole with concrete to maintain the post in place. Of course, while the cement is drying the post needs to be continually supported. Furthermore, should the post be damaged and need to be replaced, it is necessary to break up the concrete in order to remove the damaged post and replace it with another, undamaged, one.

SUMMARY OF THE INVENTION

It is one object of the present invention to provide apparatus which provides a solid support for posts, which is relatively resistant to a casual vandal, yet enables their speedy erection.

It is another object of the invention to provide a device for use in erection of a pest which allows the post to be readily replaced.

In one aspect the present invention may be considered to provide a device for use in the erection of a post comprising a tubular body portion which is adapted to be firmly installed in a supporting stratum, e.g. the ground, and has an open end adapted to receive a post to be supported, and a resiliently deformable collar having an opening adapted to receive the post and the collar being adapted to be inserted within and engage with the tubular body portion, thus to retain a post inserted therein tight engagement.

The tubular body portion, and collar have generally similar cross-sectional shapes and are preferably circular in cross-section, although they may be of any desired cross-section shape, for example square, The relative dimensions of the body portions, collar and associated post are chosen to be such as permit the collar to be positioned between the tubular body portion and associated post interengaging with each thus to secure the post in the tubular body portion.

The collar is preferably made of a resiliently compressible polymeric material, for example polyurethane or rubber (natural or synthetic).

The tubular body portion is suitably made from metal, but can alternatively be made from any other sufficiently rigid material; in some cases carbon-fibre reinforced plastics material may be suitable. Where the body portion is to be driven into the ground it is important to select a material which can be rammed into the ground without significant damage and which will provide an adequate socket for an associated post.

Suitably, in this case, the tubular body portion provided with a closed or substantially closed end, which is suitably tapered or generally hemispherical shape or other shape suitable to aid penetration, thus to facilitate driving the body portion into the ground.

In another device in accordance with the invention the tubular body portion is adapted to be inserted in a preformed hole, and concreted in place.

The tubular body portion is preferably provided with means, e.g. outwardly projecting flange portions, militating against tilting of the body portion away from a desired orientation when installed, e.g. by a transverse load applied to the post. The body portion may be provided with means militating against rotation of the body portion about its lengthwise axis after it has been installed.

A device in accordance with the invention may comprise interlocking means at an outer surface of the collar and an inner surface of the tubular body portion, adapted to interlock with one another when the collar is properly inserted in the tubular body portion, thus to militate against removal of the collar from the body portion and/or rotation of the collar relative to the body portion. In one embodiment the interlocking means comprise a plurality of resiliently deformable outwardly protruding teeth on the collar and orifices in the body portion in which the teeth engage, in use. In another embodiment the interlocking means comprises one or more lengthwise grooves or recessed in the body port ion and one or more co-operating projections on the collar so that the body portion and the collar may mutually engage in a predetermined orientation. The collar may also comprise a plurality of ridges extending along or generally around the collar, on the inner or outer surface, to provide a good interference fit with the post and body portion respectively, to retain a post in place in the body portion against withdrawal.

In a preferred embodiment the collar comprises an inwardly projecting lip around the post-receiving orifice, adapted to provide a seal militating against ingress of foreign matter between the collar and a post on which the collar is received. The lip may also extend upwardly and have a generally conical external surface to facilitate dispersal of water which may flow down the post.

Whereas the tubular body portion is, in the embodiments described in detail herein, adapted to be inserted in the ground, generally perpendicular to the surface thereof, it will be appreciated that the body portion may be fixed in other strata, for example in a roof or wall structure, or may be arranged to receive a post inclined at an acute angle, e.g. 45° to the surface of the substrate in which the body portion is inserted.

BRIEF DESCRIPTION OF DRAWINGS

Preferred embodiments of the invention will now be described with reference to the following drawings in which like numbers represent like parts and in which.

DETAILED DESCRIPTION OF PREFERRED EMBODIMENTS

Figure 1:
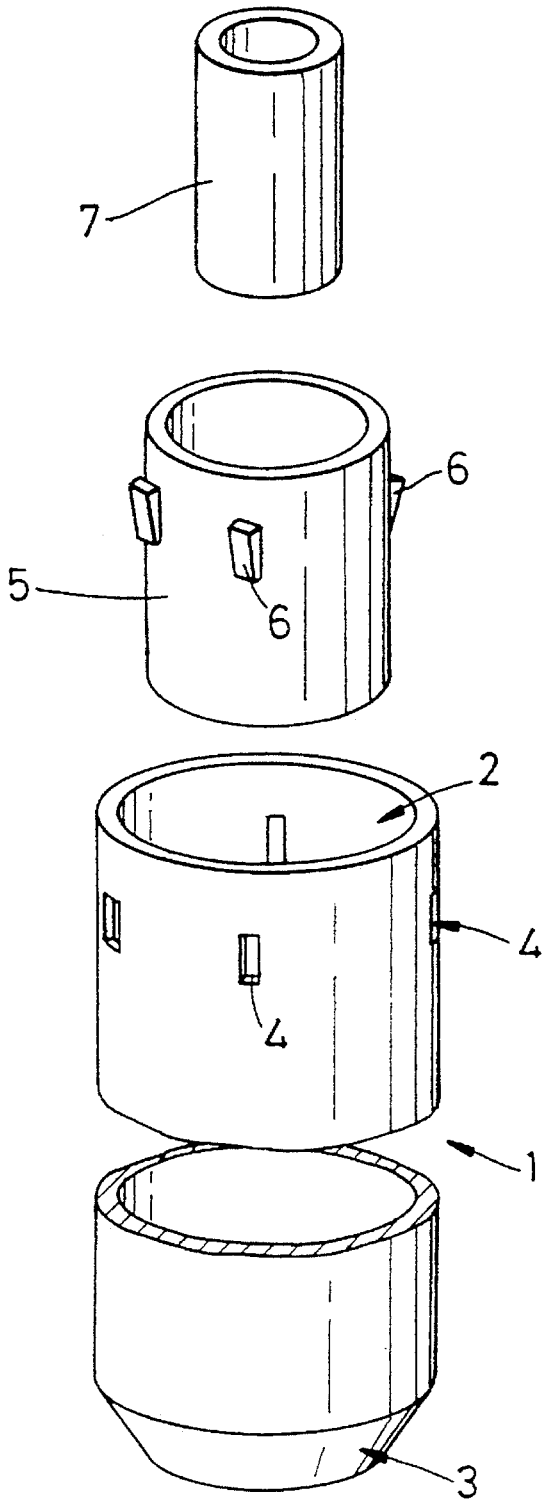
FIG. 1 is an exploded view of a first device embodying the invention, showing a first tubular body portion, a first collar and associated post.

A first device embodying the invention comprises a first tubular body portion 1 in the form of a metal cylinder, which comprises an open upper end 2, and a closed generally hemispherical opposite end 3. The body portion 1 further comprises a plurality of rectangular orifices 4 in an upper portion thereof, wherein each orifice 4 occupies the same horizontal plane the orifices being generally evenly disposed around the circumference of the body portion. A collar 5 of resiliently deformable material comprises an open ended cylinder, for receiving a post 7, the collar having a plurality of protruding teeth on the outer surface thereof, adapted to be received within the body portion 1 and said teeth being positioned to interlock with the orifices 4 in tight engagement when the collar is inserted into the open end 2 of the body portion 1 with the teeth and orifices in alignment. To this end guide means (not shown) may be provided on the collar 5 and body portion 1 so that the collar can only be inserted in the portion 1 when the teeth 6 and orifices 4 are correctly aligned. Such guide means may conveniently be a lug projecting outwardly of the collar 5, received in a longitudinal groove on the body portion 1; the lug and groove are preferably positioned so that the collar 5 adapts a predetermined position relative to the body portion 1. Alternatively a lug on the body portion i may be received in a groove on the collar.

Figure 2A:
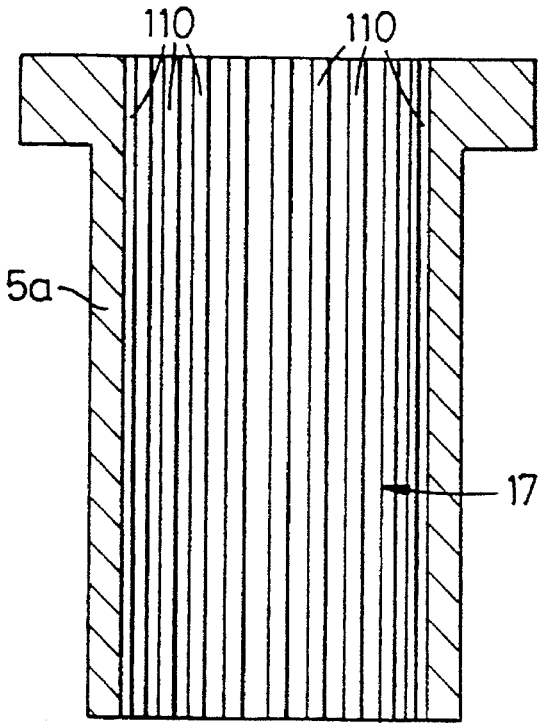
FIGS. 2(*a*) and 2(*b*) are, respectively, lengthwise section and plan views of a second collar of a device embodying the invention.
Figure 2B:
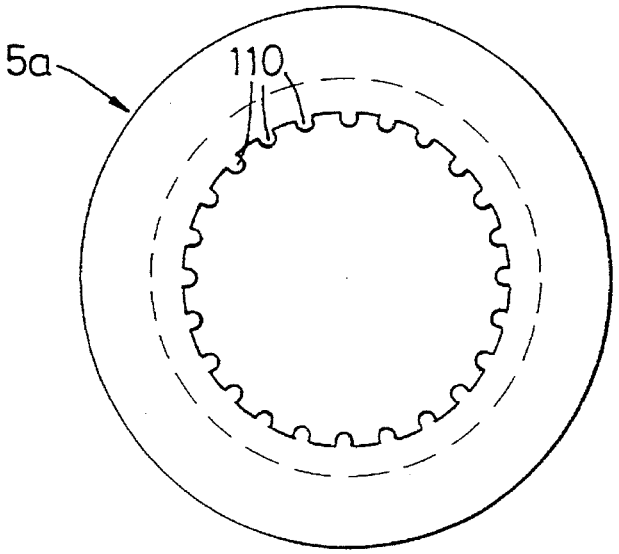
Figure 3A:
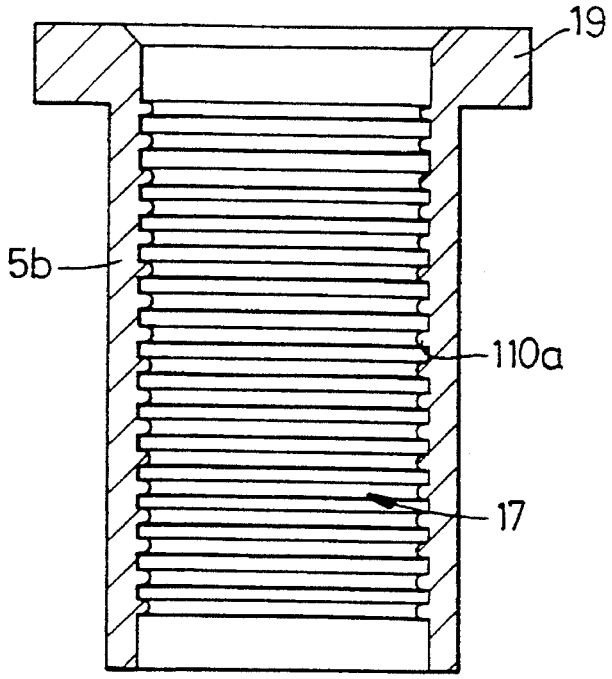
FIGS. 3(*a*) and 3(*b*) are, respectively, lengthwise section and plan views of a third collar of a device embodying the invention.
Figure 3B:
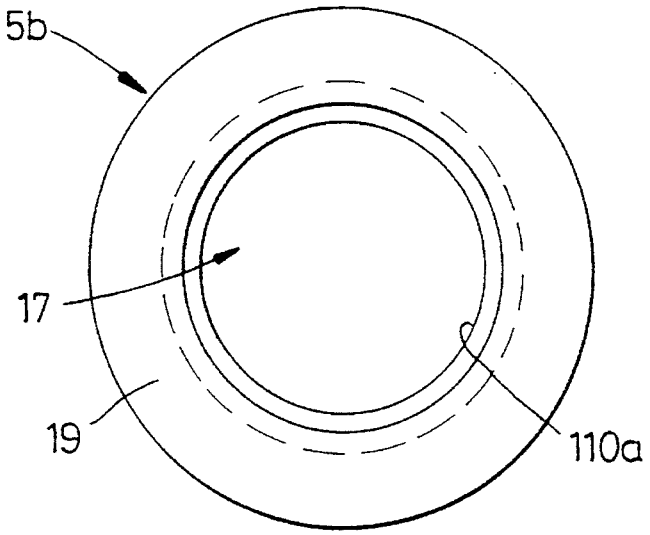

A preferred collar provides a tight interference fit between tubular body portion and post, thereby to secure the post 7 in position. In preferred collars 5*a*, 5*d* lengthwise extending ridges 110 (see FIGS. 2 and 5) are provided on an inner surface defining an opening in which a post is to be received, to facilitate insertion of the post. However, the ridges and grooves can be of any suitable geometry, for example circumferential as the ridges 110*a* in a third collar (FIG. 3), or even helical (not shown) in other collars of devices embodying, g the invention and may be provided on internal or external surfaces of the collar or, indeed, both surfaces if desired. The ease of insertion and withdrawal when assembling or dismantling the device is dependent on the form and depth of any ridges, to some extent. Furthermore, the use of lengthwise ribs 110 also accommodates slight variations of post size, for example as may arise through manufacturing tolerances. Moulding the collar in two (or more) operations may also provide desired characteristics, e.g. with a relatively rigid annular core, inner and outer surface portions of a somewhat softer, more compressible, preferably high hysteresis, material may provide greater grip to post and body portion than the core material.

The collars of devices embodying the invention are of resiliently deformable material, preferably polyurethane of a suitable hardness: if hardness is too great, assembly is too difficult and if too soft collars tend to collapse. A Shore D hardness of about 65 with a collar minimum wall thickness (i.e. excluding any ridges) of about 5 mm has been found suitable for many applications. Casting of the collars will be difficult, if the wall thickness is too low, as well as providing too little deformation.

The collars may comprise reinforcing means moulded integrally with the collar, for example a wire mesh or any other suitable means e.g. carbon fibre or woven or non-woven textile fibre.

Figure 4A:
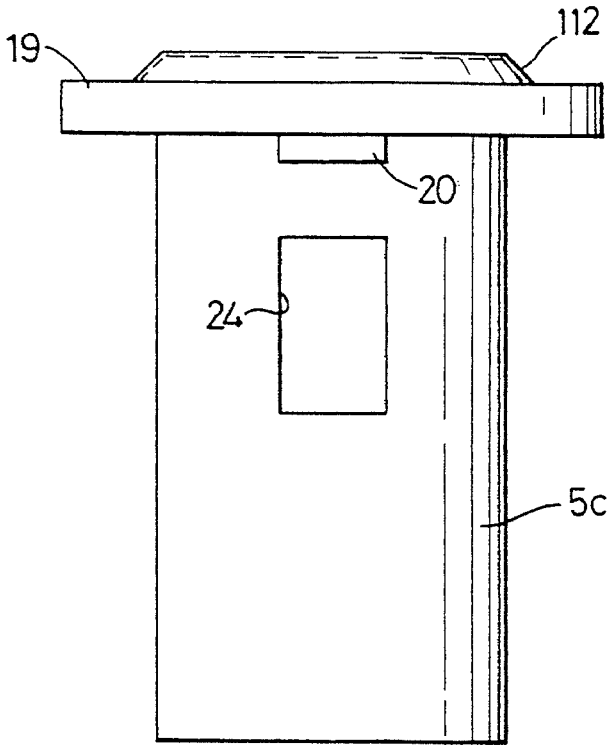
FIGS. 4(*a*) and 4(*b*) are, respectively, side and lengthwise section views of a fourth collar of a device embodying the invention.
Figure 4B:
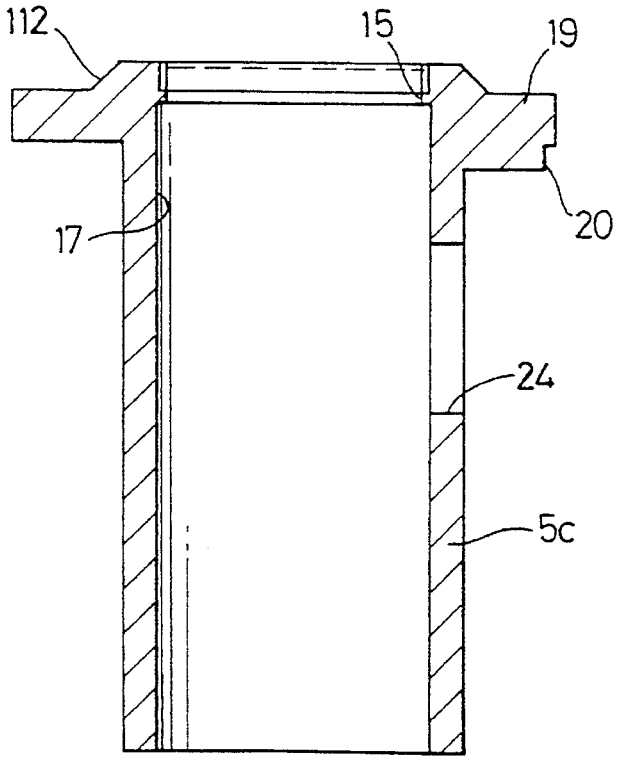

FIGS. 4(*a*) and 4(*b*) show a fourth collar 5*c* for a fourth device embodying the invention. The collar 5*c* comprises an inwardly projecting lip 15 which projects inwardly around the central opening 17 in which a post is to be received and projects upwardly above the level of a flanged end portion 19 of the collar 5*c* to form a tight seal; between the collar 5*c* and post inserted therein whereby to prevent ingress of dirt and any other foreign matter between post 7 and collar 5*c;* the flange 19 may prevent ingress of foreign matter between the collar 5*c* and a co-operating tubular body portion. The outer surface 112 of the lip is preferably frustoconical to facilitate shedding of water from the collar.

Figure 5:
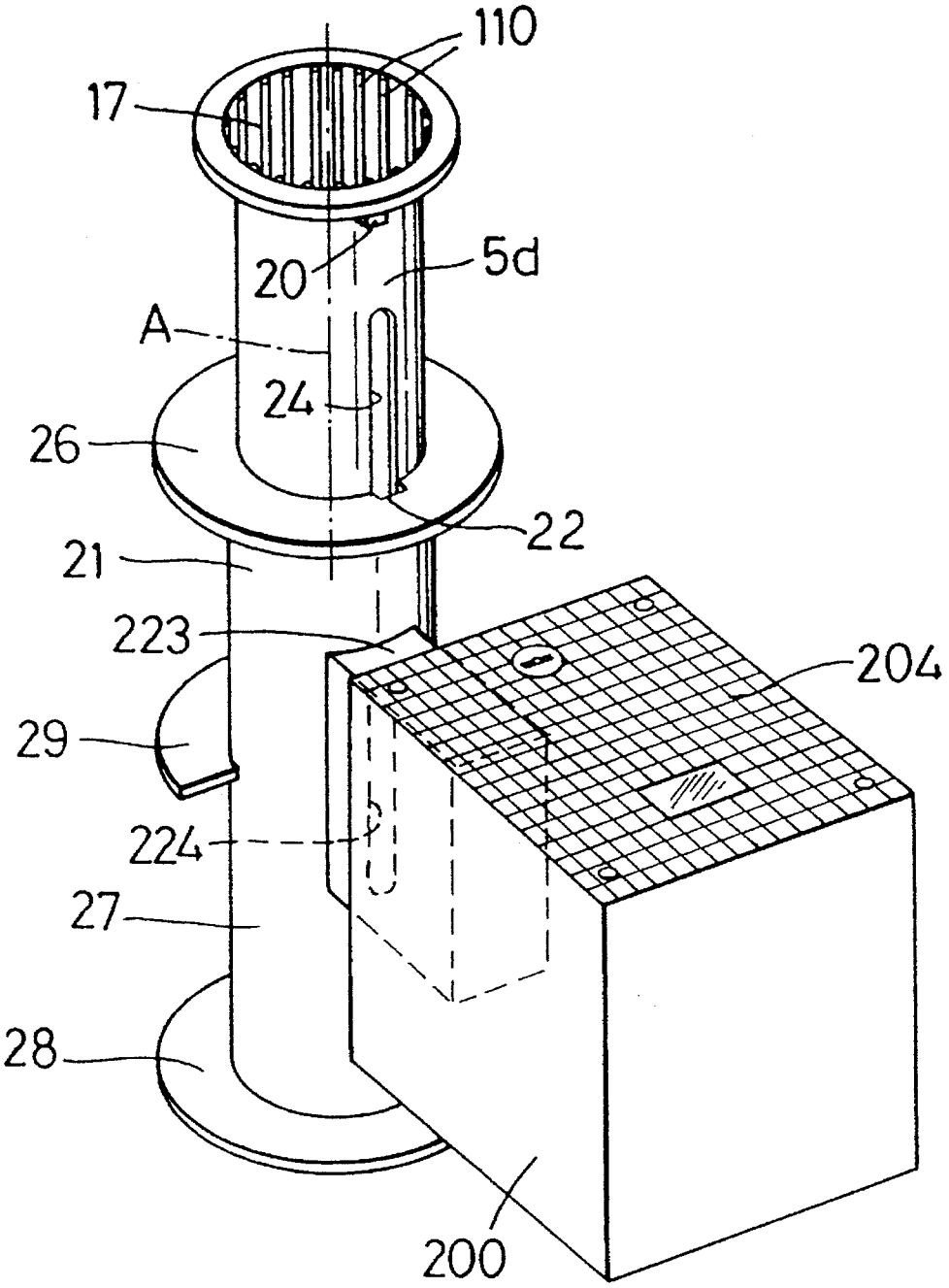
FIG. 5 is an exploded view of a device embodying the invention showing a second tubular body portion, fifth collar, and including an inspection pit, adapted to be concreted in place.

From an underface of the flange 19 a small lug 20 projects. This lug is adapted to seat in a corresponding recess 22 at the open end portion of a tubular body portion 21, e.g. as shown in FIG. 5, whereby to locate the collar 5*c* and body portion 21 in a desired orientation around the lengthwise axis of the tubular body portion. This ensures that an opening 24 in the collar 5*c* is accurately aligned with a corresponding opening 224 (FIGS. 5, 6 and 7) in the body portion so that electrical (or other) services can be introduced through the collar 5*c* and body portion 21 to the post 7, e.g. for illuminating a sign or operating traffic lights.

The body portion 21 (FIG. 5) comprises upper and lower flanges 26, 28 secured at opposite ends of a tubular core 27. An intermediate flange 29 is also secured to the core and extends part way round it. Adjacent a lower end portion of the core 27 an internal support ring (not shown) may extend around the core and is secured thereto.

The flange 29 is positioned between and parallel to the flanges 26, 28, and lying in a plane perpendicular to a longitudinal axis A of the portion 21. The provision of the additional flange 29 may serve a number of functions, for example if a post of the device is struck, the additional flange may facilitate transfer of the shock to the concrete in which the body portion, 21 is embedded and militate against distortion of the body portion, as well as providing further stability. One or more intermediate flanges may be used, as desired; the plane of any intermediate flange may be other than perpendicular to the axis A and if inclined to the axis may be oriented to provide greatest resistance to impact from a most likely direction, for example if used in the installation of posts on motorway central reservation barriers adjacent one of the carriageways, the direction of traffic on that carriageway. Instead of a single intermediate flange, a helical metal strip (generally in the form of an augur) suitably extending between the flanges 26, 28, or a projecting wire support, or other means, could be welded to or otherwise fixed to the exterior of a tube of the tubular body portion to provide reinforcement and resistance to rotation of the body portion.

Figure 6:
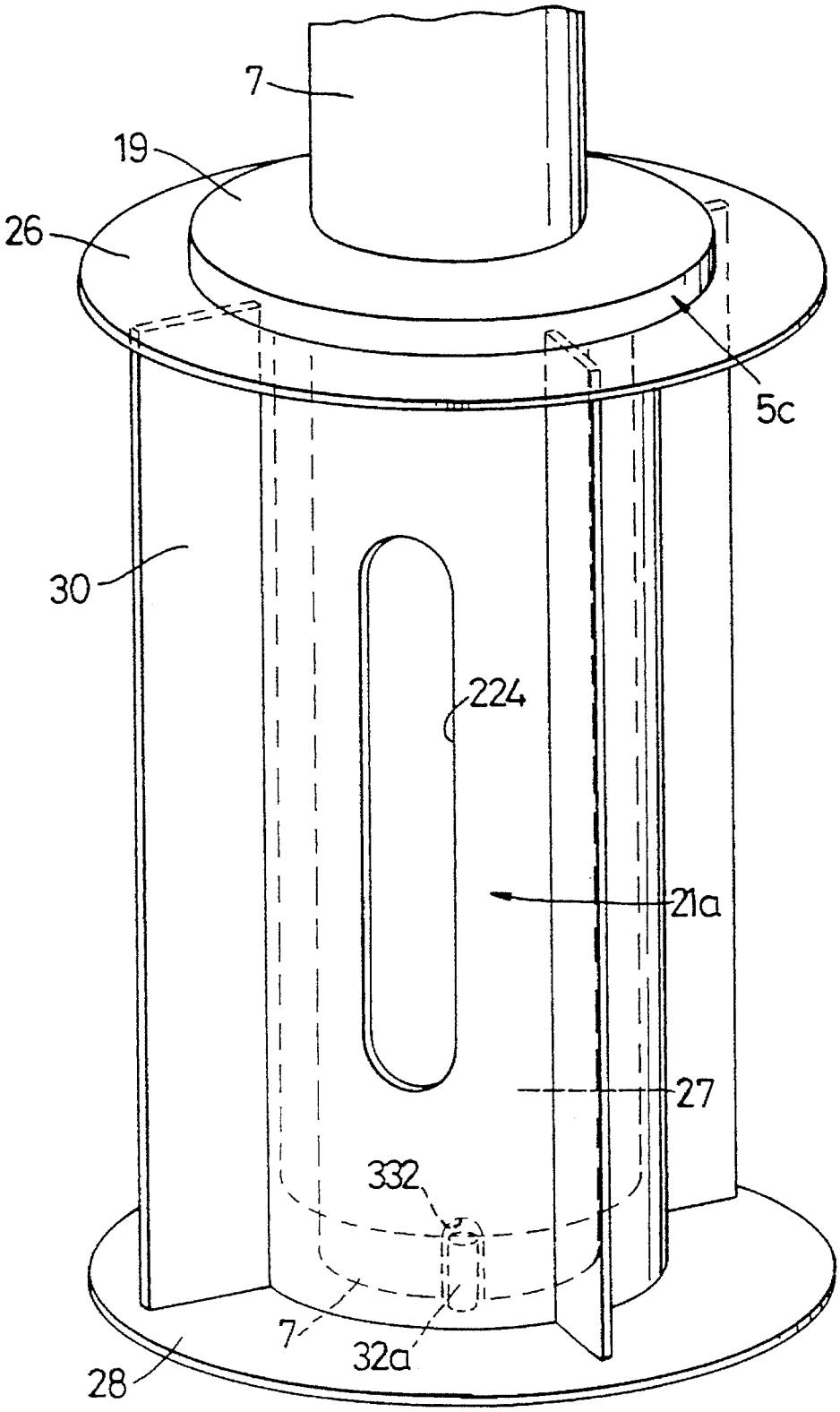
FIG. 6 is a perspective view of a third tubular body portion and sixth collar of a device embodying the invention.

In FIG. 6 is shown a device comprising a tubular body portion 21*a* generally similar to the body portion 21 except that it comprises lengthwise vanes 30 which help to prevent rotation of the body portion and a lengthwise projecting peg 32*a*, secured to a part of a plate providing the flange 28 within the tube 27 of the body portion positioned to be slidingly received in a lengthwise extending slot 332 in a post 7, to prevent rotation. Prevention of rotation and/or correct orientation of parts may be achieved in other ways, or the post may be locked in position by a bayonet-type joint in which an inwardly projecting peg on the tube portion is received in a slot, suitably L-shaped at the lower end portion of a post by a lengthwise motion, followed by a rotary motion.

Figure 8:
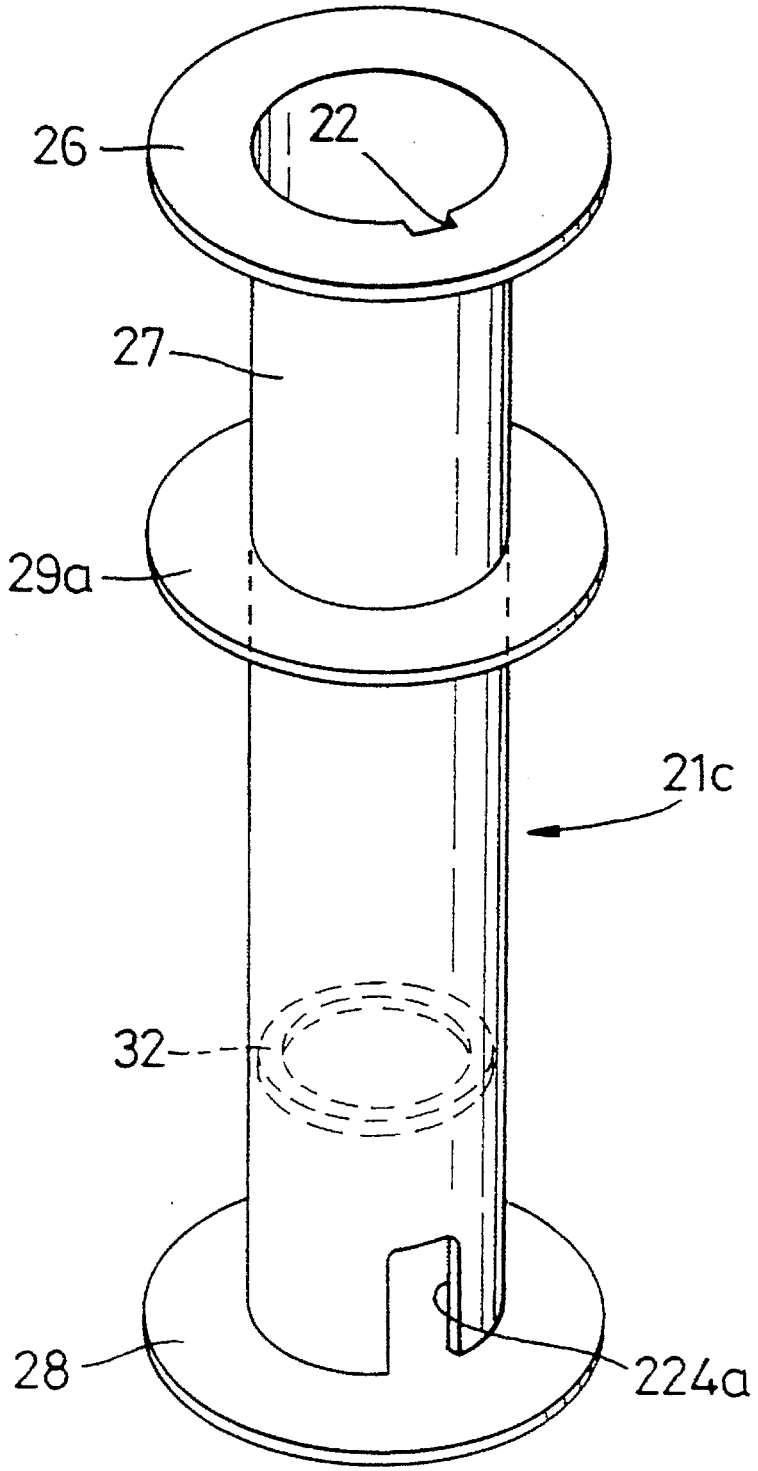
FIG. 8 is a perspective view of a tubular body portion of a device embodying the invention.
Figure 9:
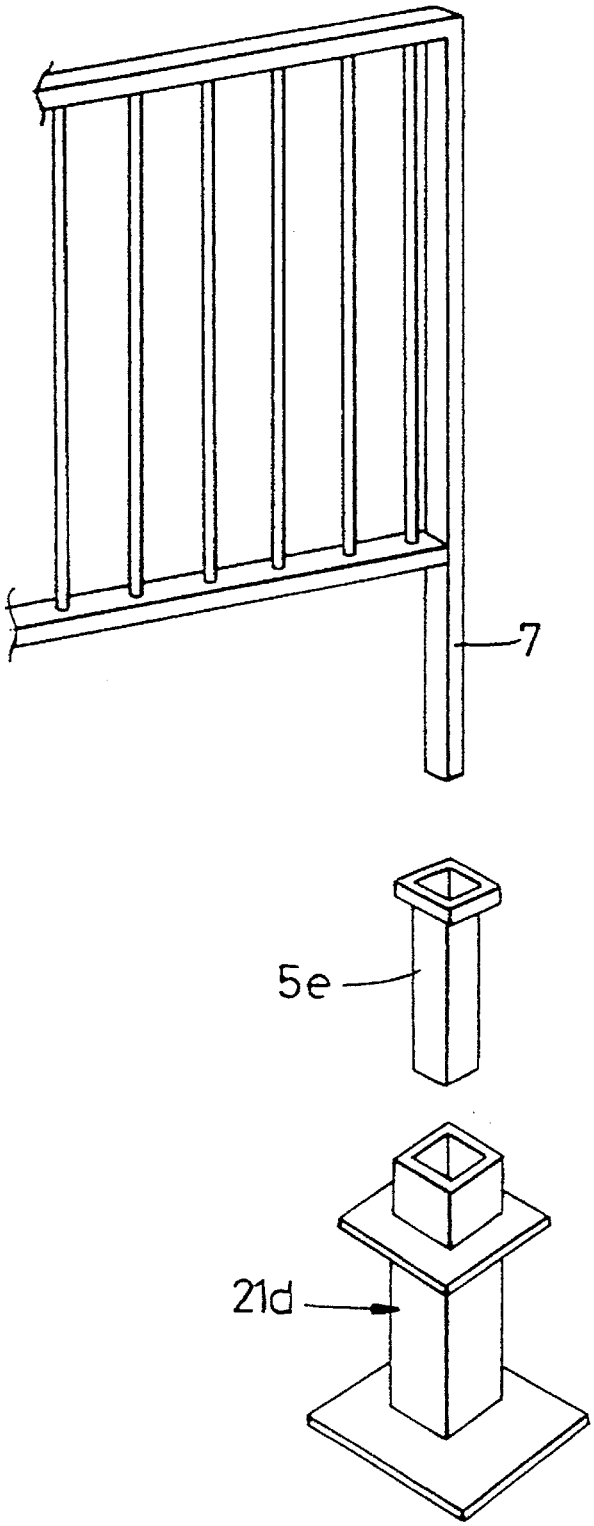
FIG. 9 is an exploded perspective view showing a sixth, rectangular tubular body portion and eighth collar, of a device embodying the invention for use in erecting a barrier.

FIG. 8 shows a body portion 21*c* somewhat similar to the body portion 21 but with a complete annular intermediate flange 29*a* and a lengthwise access slot 224*a* at the lower end portion instead of the opening 224. An internal support ring 32 extends around the core and is secured to it. When a post is inserted in the body portion 21*c* the ring 32 is positioned to be engaged by the lower end of the post thus to locate the post lengthwise, spaced from the flange to ensure that wires introduced through the opening 224*a* are not damaged by the post.

Preferably, where introduction of wiring is necessary, the body portion 21 is installed in association with an inspection pit 200 (FIG. 5). The body portion may be received in a complementary part-cylindrical channel with the opening 224 in the body portion 21 opening directly into the inspection pit 200 through an aligned opening. An appropriate opening may be provided in the post. Preferably, however, the pit 200 is connected to the body portion 21 by an integral conduit 223 which opens into the opening 224 and is secured to the body portion 21 by bolts (not shown). The bolts may, if desired, be pointed and arranged to engage the post. This latter construction using conduit 223 permits a greater mass of concrete to be cast in close proximity with the portion 21. A lid 204, which may be lockable, is provided, The inspection pit 200 is conveniently made of any suitable material, for example a plastics material, e.g. polypropylene. Where a body portion 21*a* is used wires may be introduced to the post through the open lower end of the post.

Figure 7:
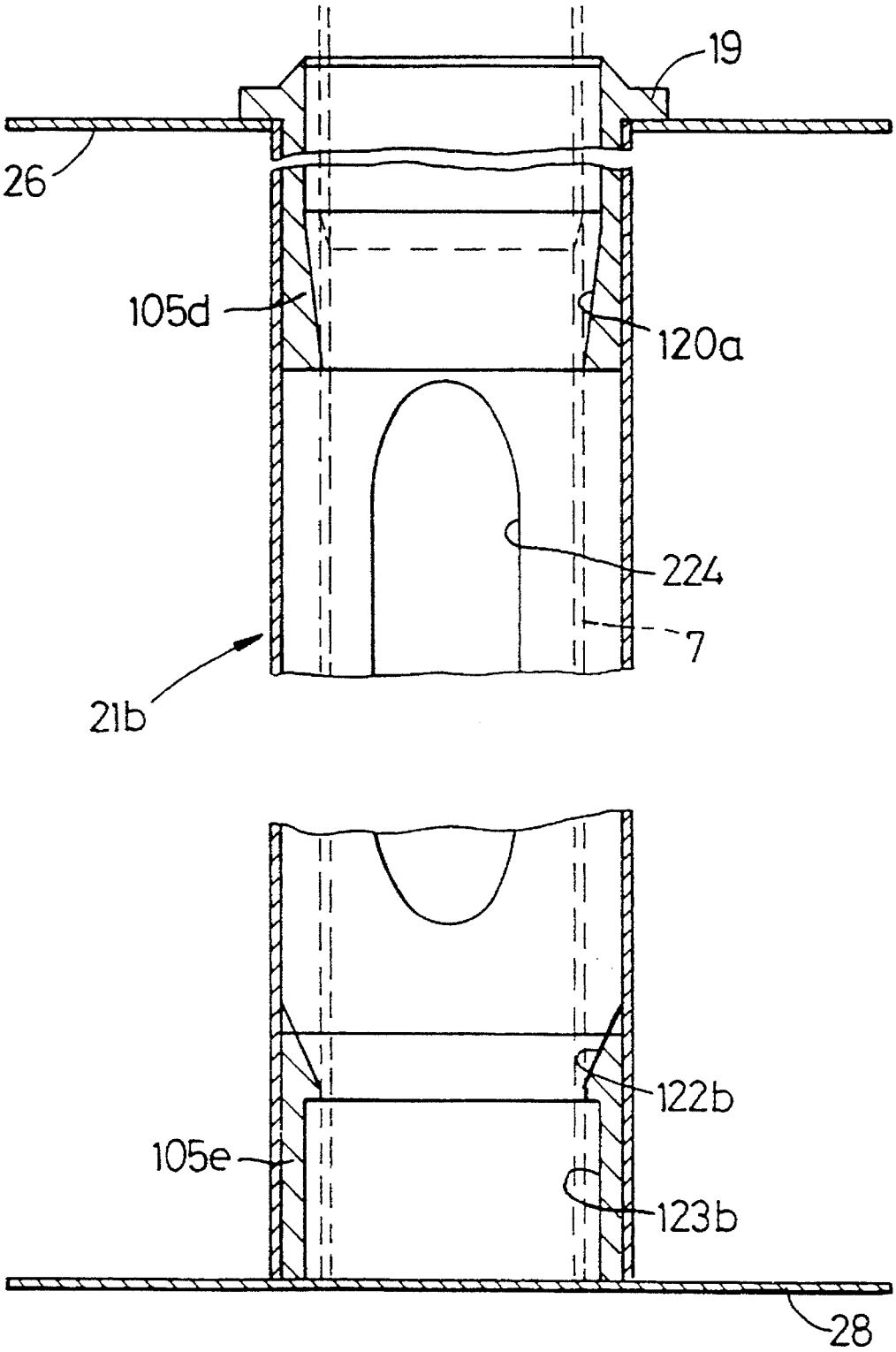
FIG. 7 is a view of a device embodying the invention, including a fourth body portion and a seventh two-part collar.

FIG. 7 shows a device having a two-part collar 105*d*, 105*e*. The upper part 105*d* may be of any desired configuration, for example as described previously, but as shown comprises a tapering constricted portion 120*a* remote from the flange 19. If desired the end portion of the collar remote from the flange 19 may be severed to adjust the "grip" afforded by the collar on an inserted pole and this feature may be used on single collars, e.g. collars otherwise similar to the collar 5*a*, if desired.

The lower part 105*e* has a tapering entrance portion 122*b* with a lengthwise extending ridge/grooved portion 123*b* below the entrance portion 122*b*. Especially for posts 7*e* which require deep insertion, the provision of a two part collar reduces costs whilst still providing adequate holding power. The upper or lower part may, if suitably designed, be used alone. Thus a relatively small number of appropriately designed mouldings may, by suitable selection, be used to deal with a wide variety of different uses.

The body portions 21, 21*a*, 21*b*, 21*c* and 21*d* shown in FIGS. 5 to 9 are intended to be concreted in place in a preformed hole (which may be dug or made using a suitable augur or boring machine): this is especially useful in some circumstances, e.g. in pedestrian areas in cities which may be paved, for example with appropriately laid bricks or other paving, where it is not possible to ram or hammer a body portion into the ground because that would damage the paving.

In use the body portion 21*c* is seated at the bottom of a hole excavated in the ground and concrete is poured into the hole around the core 27 and allowed to set to hold the body portion 21 in place. The portion 21 is positioned in a desired orientation so that the opening 224 is correctly oriented for introduction of electrical wiring or other services. The upper flange 26 overlays the surrounding paving or other surface to some extent, hiding the excavation and disrupted paving where the excavation has occurred and presenting an attractive decorative appearance. Although the upper flange 26 in FIGS. 5 and 8 is circular, in a body portion in accordance with the invention, the upper flange may be of any desired shape in plan, e.g. rectangular (FIG. 9) or hexagonal, for example to match the surrounding paving.

The body portion 1 (FIG. 1) is driven into the ground typically by a hydraulic ram (of a type known to those skilled in the art as a hydraulic post inserting machine) up to the extent shown in FIG. 1, leaving the orifices 4 above the surface of the ground.

In a preferred assembly method the appropriate collar is first inserted into the body portion and thereafter the selected pole introduced into the collar and forced home. Preferably a suitable lubricant composition (which may be a soap-based product, for example a mixture of fatty acids and fatty surfactants in an aqueous base with small amounts of solvent and inorganic material) is applied to facilitate the forcing of the post into the collar. Alternatively an appropriate collar is slid onto the base of the selected post 7 and the combination of collar and post forced into engagement with the body portion, (which provides a socket for the post). The assembly is such that the teeth 6 and the orifices 4 interlock (in the FIG. 1 device), or that the collar retains the post in place solely by friction in the other devices. Typically this forced engagement causes slight deformations in the collar 5, which serve to constrict the collar, thus to grip the post 7 firmly. The grip is sufficient to prevent the rotation of the post relative to the body portion, where there are no teeth and to prevent vandals from casually pulling the post out, yet permits the removal of the post by an appropriately equipped person. Such a person would use a pulling tool, common to the art, for directly wrenching out the post, after first applying lubricant, if necessary. Though the collar may occasionally be damaged it is usually possible to remove the post without damage to the collar or body portion, so that the collar can readily be re-used. The collars for common 76 mm diameter traffic sign posts must be a very tight fit to provide satisfactory grip and use of lubricant may be essential. Larger diameter posts, e.g. 115 mm traffic light posts may not require such tight grip (though grip must nevertheless be substantial in view of the greater masses and contact surface area which would normally be involved).

If desired, for example when installing posts for motorway crash barriers, a body portion, for example the body portion 21 may be embedded in a concrete block of a desired shape, conveniently cylindrical and the pre-cast block dropped into a pre-formed hole. Conveniently, using a cylindrical block, a hole may be made using a suitable augur. A removable cap may be placed over the exposed opening in the tubular body portion to prevent ingress of debris during installation whether carried in a pre-cast block or being concreted into a hole into which concrete is poured and allowed to set round the body portion. The pre-cast block, after positioning in the hole is maintained in place by compaction of the surrounding ground.

Various aspects of the body portion 21, e.g. the vanes 30, peg 32*a*, upper flange 26 and recess 20 may be used in a body portion adapted to be rammed or otherwise driven into the ground as the body portion 1, if desired. Likewise various features of the different collars described herein may be used in devices with body portions adapted to be rammed or otherwise secured in a substratum as appropriate.

Where the body portion is adapted to be installed so that a post secured therein is inclined at an acute angle to the surface of the substratum the upper flange may be inclined at a corresponding angle to the axis of the body portion so that it may seat contiguously with the surface.

The illustrative devices are especially suitable for use in erecting road traffic signs or traffic lights but can be used for other applications involving erection of posts, for example motorway crash barriers, pedestrian barriers (see FIG. 9), security fences, including for example British Rail trackside fences and other fences, supports for overhead cables, e.g. for railway or tram use, and lamp posts, including posts for seasonal lighting, e.g. Christmas, at seaside resorts or in city streets.

In all cases the illustrative devices can be readily installed and provide security against unauthorised removal. The illustrative devices which rely on friction between the collar and post on the one hand and body portion on the other, permit the use of standard posts, without any projections or other interlocking members thus do not require special post constructions for effective operation. It is, of course, necessary to ensure that the friction characteristics are satisfactory and that the physical characteristics of the collar give a desired degree of security, while yet permitting removal and replacement of posts readily, using the correct equipment and that chemical characteristics resist degradation in ambient conditions (which may be very severe in road traffic signs).

I claim:

1. A device for use in the erection of a post comprising:

a tubular body portion which is adapted to be firmly installed in a supporting stratum and has an open end adapted to receive a the post to be supported, the tubular body portion includes means adapted to be seated in a preformed hole in the supporting stratum and held in place therein; and a first resiliently deformable collar adapted to be received within said body portion, the collar having an opening adapted to receive the post in forced engagement and the collar comprising a plurality of lengthwise-extending inwardly projecting ridges on an inner surface of the collar defining the opening therein thus to grip the post inserted therein and retain the post in tight engagement.

2. A device as in claim 1 wherein the tubular body portion and the resiliently deformable collar are of circular cross-section.

3. A device as in claim 1 wherein the collar is made from polyurethane.

4. A device as in claim 1 wherein the resiliently deformable collar further comprises a plurality of outwardly projecting ridges adapted to tightly engage said body portion.

5. A device according to claim 1 comprising an outwardly projecting flange around the open end of the body portion.

6. A device according to claim 5 comprising one or more vanes projecting outwardly from a tubular core of the body portion.

7. A device according to claim 1 adapted to retain the post by friction forces between the collar and the post and the collar and the body portion.

8. A device according to claim 1 comprising engaging means on the post and the body portion to orient the body portion and the post in desired relative orientation and to prevent relative rotation thereof.

9. A device according to claim 1 comprising engaging means on the body portion and the collar to orient the body portion and the collar in a desired orientation and to prevent relative rotation thereof.

10. A device according to claim 1 comprising means on the collar adapted to engage the post to provide a seal.

11. A method of erecting a post using a device according to claim 1, the method comprising installing the body portion in the supporting stratum, and introducing the post and the resiliently deformable collar into the body portion, and forcing the post and the collar into tight engagement with the body portion thus to retain the post in position.

12. A device according to claim 1 wherein the tubular body portion further comprises means militating against tilting of the body portion away from a desired orientation, when installed.

13. A device according to claim 12 wherein said means militating against tilting comprises an outwardly projecting flange portion.

14. A device according to claim 13 comprising one or more vanes projecting outwardly from a tubular core of the body portion.

15. A device according to claim 1 wherein the collar has a Shore D hardness of about 65 with a collar minimum wall thickness of about 5 mm.

16. A device according to claim 1 comprising reinforcing means molded integrally with the collar.

17. A device according to claim 1 wherein the collar comprises a relatively rigid core and inner and outer surface portions of softer more compressible material.

18. A device according to claim 1 wherein the collar comprises an outwardly projecting ranged end portion which overlies said open end of said tubular body portion.

19. A device according to claim 18 wherein the collar further comprises an inwardly projecting lip which projects inwardly around the post-receiving opening and upwardly whereby to form a fight seal between the collar and the post inserted into the opening.

20. A device according to claim 19 wherein the outer surface of the lip is frustoconical.

21. A device according to claim 18 wherein the collar further comprises lug projecting from an underface of the ranged end portion seated in a recess at said open end of said tubular body portion whereby to locate the collar in a desired orientation relative to the tubular body portion.

22. A device according to claim 1 wherein the tubular body portion has an opening, the device comprising an inspection pit connected to the tubular body portion and providing access to said opening for introduction of wiring.

23. A device according to claim 1 further comprising a second resiliently deformable collar housed in said tubular body portion at a lower end remote from said open end and having a tapering entrance portion.

* * * * *